US005213932A

United States Patent [19]

Shimazaki

[11] Patent Number: 5,213,932

[45] Date of Patent: May 25, 1993

[54] MAGENTA TONER FOR ELECTROPHOTOGRAPHY

[75] Inventor: Hiromitsu Shimazaki, Fukuoka, Japan

[73] Assignee: Matsushita Electric Industrial Co., Ltd., Osaka, Japan

[21] Appl. No.: 841,102

[22] Filed: Feb. 25, 1992

[30] Foreign Application Priority Data

Feb. 25, 1992 [JP] Japan ..... 3-29890

[51] Int. Cl.[5] ..... G03G 9/09

[52] U.S. Cl. ..... 430/106

[58] Field of Search ..... 430/106

*Primary Examiner*—Roland Martin

*Attorney, Agent, or Firm*—Lowe, Price, LeBlanc & Becker

[57] ABSTRACT

A magenta toner for electrophotography which comprises a binder resin and from 0.1 to 10 parts by weight of a colorant per 100 parts by weight of the binder resin. The colorant contain a mixture of from 40 to 60 parts by weight of a Rhodamine dye classified as C.I. Solvent Red 49 and, correspondingly, from 60 to 40 parts by weight of a pigment classified as C.I. Pigment Red 48. The toner may be mixed with a carrier to provide a two-component system. The toner has improved weatherability while keeping a good chromaticity.

12 Claims, No Drawings

MAGENTA TONER FOR ELECTROPHOTOGRAPHY

BACKGROUND OF THE INVENTION

1. Field Of The Invention

This invention relates to the art of electrophotography and more particularly, to a magenta toner for electrophotography which is useful for function color, full color or multi-color electrophotography and is able to yield clear color images when used in either a one-component system or a two-component system.

2. Description of The Prior Art

Known color toners for electrophotography which have been widely employed in the art are those toners of the type in which colorants such as dyes or pigments are dispersed in binder resins. Magenta colorants for color electrophotography are, for example, rhodamine dyes and pigments, thioindigo pigments, and quinacridone dyes and pigments. Quinacridone pigments have been proposed, for example, in Japanese Kokai No. 49-46951 and thioindigo pigments have been proposed in Japanese Kokai No. 55-26574.

The colorants for magenta toner which are used in color electrophotography should meet the following requirements.

(1) Good spectral reflection characteristics.

(2) Good weatherabilities such as light fastness and heat resistance.

(3) Good miscibility with resin binders and good transparency.

(4) Freedom of breeding.

(5) Matching with a developing system of duplicators.

(6) No toxicity.

The known magenta toners may meet part of the above requirements (1) to (6) but are not always satisfactory with respect to all the requirements.

In particular, a magenta toner which comprises Color Index (hereinafter abbreviated as C.I.) Solvent Red 49 Rhodamine dye is difficult to ensure a desired degree of chroma, coupled with another problem that it is relatively poor in weatherability and, particularly, light fastness.

SUMMARY OF THE INVENTION

It is accordingly an object of the invention to provide a magenta toner for electrophotography which satisfies the requirements set out above and ensures controlled hue and chromaticity with a clear chroma.

It is another object of the invention to provide a magenta toner, either in a one-component system or in a two-component system, which has good weatherabilities such as good light fastness and a good heat resistance.

It is a further object of the invention to provide a magenta toner which does not color a silicone rubber roller.

The above objects can be achieved, according to the invention, by a magenta toner for electrophotography which comprises a binder resin and from 0.1 to 10 parts by weight of a colorant per 100 parts by weight of the binder resin, the colorant containing from 40 to 60 parts by weight of a Rhodamine dye classified as C.I. Solvent Red 49 and, correspondingly, from 60 to 40 parts by weight of a pigment classified as C.I. Pigment Red 48. The chromaticity of the colorant expressed by a L*a*b*c* chromatic system should preferably satisfy the requirements that $L^*=50.0$ to 80.0, $a^*=61.0$ to 80.0, $b^*=-10.0$ to 40.0, and $C^*=60.0$ to 80.0. In this chromatic system, L* indicates a color value, a* and b*, respectively, indicate a hue, and C* indicates a chroma.

DETAILED DESCRIPTION AND EMBODIMENTS OF THE INVENTION

In the practice of the invention, the magenta toner is made of a specific type of colorant dispersed or dissolved in a binder resin. The amount of the colorant is generally in the range of from 0.1 to 10.0 parts by weight, preferably from 2.0 to 6.0 parts by weight, per 100 parts by weight of the binder resin. If the amount is less than 0.1 part by weight, good color developing characteristics are not obtained with a desired color density being not attained.

When the amount exceeds 10 parts by weight, the solubility of the colorant in the binder resin is lowered, with the attendant problem such as of liability to breeding.

The binder resins useful in the present invention may be known ones which are ordinarily used for this purpose. Specific examples include styrene resins, i.e. homopolymers or copolymers of styrene and/or substituted styrene compounds, such as polystyrene, poly-α-methylstyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate copolymers, styrene-methacrylate copolymers, styrene-methyl α-chloroacrylate copolymers, styrene-acrylonitrile-acrylate copolymers and the like, epoxy resins, urethane-modified epoxy resins, silicone-modified epoxy resins, polyester resins, vinyl chloride resins, rosin-modified maleic resins, phenoxy resins, polyethylene, polypropylene, ionomer resins, polyurethane resins, silicone resins, ketone resins, ethylene-ethyl acrylate resins, xylene resin, polyvinyl butyral resins, terpene resin, phenolic reins, aliphatic or alicyclic hydrocarbon resins, and the like. These resins may be used singly or in combination. Preferably, styrene-acrylate resins, styrene-methacrylate resins and polyester resins are used singly or in combination.

The colorant is made of a Rhodamine dye classified as C.I. Solvent Red 49 and a pigment classified as C.I. Pigment Red 48. The C.I. Solvent Red 49 is a compound of the following formula (1)

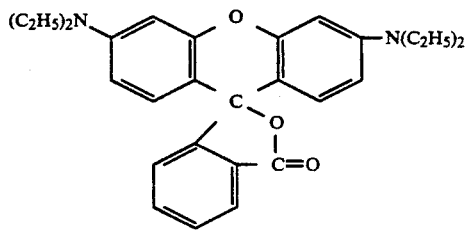

(1)

The C.I. Pigment Red 48 is a compound of the following formula (2) or (3)

(2)

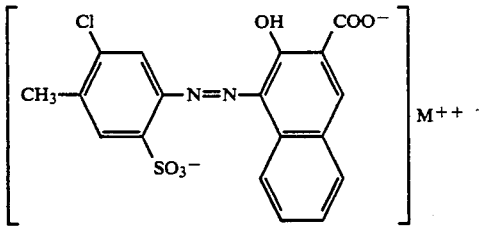

wherein M represents Ca, Ba, Sr or Mn, (3)

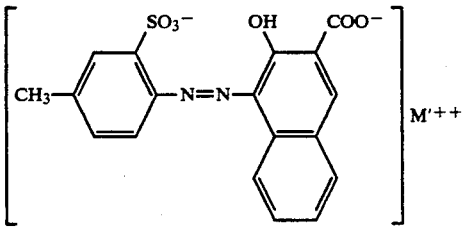

wherein M' represents Ca or Na provided that when Na is used, two Na ions are bonded as M'.

These two types of C.I. Pigment Red 48 may be used singly or in combination without limitation.

When the total amount of the colorant is taken as 100 parts by weight, the C.I. Solvent Red 49 should be contained in an amount of from 40 to 60 parts by weight and the C.I. Pigment Red 48 should be contained, correspondingly, in an amount of from 60 to 40 parts by weight. Preferably, the colorant consists essentially of the C.I. Solvent Red 49 and the C.I. Pigment Red 48.

The colorant is generally used in an amount of from 0.1 to 10 parts by weight, preferably from 2 to 6 parts by weight, per 100 parts by weight of the binder resin as stated hereinbefore. Within this range, the chromaticity of the toner as expressed by the L*a*b*c chromatic system can satisfy the requirements for the color value, hues and chroma as follows: $L^*=50.0$ to 80.0, $a^*=61.0$ to 80.0, $b^*=-10.0$ to 40.0, and $C^*=60.0$ to 80.0.

The magenta toner of the invention may be used as a one-component toner or may be used as a two-component toner. With the two-component toner, there are used known carriers including, for example, particles of iron whose surface may be oxidized or may not be oxidized, alloys of iron and nickel, copper, zinc, cobalt, manganese, chromium and/or rare earth metals, or oxides of these metals or alloys. In addition, the particles may be coated with various types of resins as usual.

If necessary, a flow control agent such as colloidal silica may be added to the toner in an amount of from 0.01 to 6.0 wt %, preferably from 0.1 to 1.0 wt %, based on the total toner composition. The flow control agent may be used in either a one-component system or a two-component system.

Other additives such as antistatic agents, release agents and the like may be added to the toner, if desired. A typical and preferred release agent is, for example, polypropylene. If the polypropylene release agent is used, its content in the toner is in the range of from 0.1 to 5.0 parts by weight per 100 parts by weight of the binder resin.

The magenta toner of the invention may be prepared by a usual manner as specifically set forth in examples appearing hereinafter. Briefly, binder resins, the colorant and, if desired, additives are uniformly dispersed in a mixing device such as the Henschel mixer and kneaded under melting conditions. The resultant melt is cooled and finely divided into pieces such as a jet mill to obtain particles having a size of from 5 to 15 μm, preferably from 7 to 11 μm. If necessary, the toner may be further mixed with a flow control agent. With the two-component composition, a carrier is added to the toner in an amount of from 88 to 97 wt % based on the mixture of the carrier and the toner or the final developer.

In the practice of the invention, the red dye classified as C.I. Solvent Red 49 and the pigment of C.I. Pigment Red 48 are used in combination. This combination can significantly improve weatherabilities while keeping the chroma at a high level. In addition, the toner of the invention exhibits negative chargeability and is excellent as a negatively charging toner, ensuring a clear magenta color print.

The present invention is more particularly described by way of examples, which should not be construed as limiting the invention. In examples, parts and percent are by weight unless otherwise indicated.

EXAMPLE 1

| | |
|---|---|
| Styrene-acrylate resin (Himer TBL-500, available from Sanyo Chem. Co., Ltd.) | 100 parts |
| Polypropylene (Biscoal 550-P, available from Sanyo Chem. Co., Ltd. | 4 parts |
| Antistatic agent (Bontron E-84, Orient Chem. Co., Ltd.) | 2 parts |
| Colorant (mixture at a mixing ratio by weight of 1:1 of C.I. Solvent Red 49 (Oil Pink 312, available from Orient Chem. Co., Ltd.) and C.I. Pigment Red 48 (Dainichi Permanent Red, available from Dainichi Pure Chem. Co., Ltd.) | 5 parts |

The composition of the above formulation was uniformly mixed in the Henschel mixer and the resultant dispersion was kneaded under melting conditions by means of a biaxial extruder. After cooling, the mixture was finely powdered by means of a jet mill and subjected to classification to obtain classified particles with an average size of 11 μm. Thereafter, 3% of hydrophobic silica powder (R972, available from Nippon Aerosil Co., Ltd.) was externally added to and mixed with the particles to obtain a magenta toner. The thus obtained toner was further mixed with a ferrite carrier (FL-150, available from Nippon Iron Powders Co., Ltd.) to obtain a two-component developer. The developer was set in a laser printer (KX-P4450 of Matsushita Electric Industrial Co., Ltd.), followed by continuous printing of 20,000 sheets.

The resultant print had a clear magenta color and was found to be satisfactory in color as a magenta toner.

In order to check the light fastness of the print, it was subjected to a forced irradiation test of 500 hours using a sunshine weatherometer. As a result, it was found that the magenta color was not faded. Moreover, the print was allowed to stand in a thermostatic chamber at 5° C. for 12 hours. The tint was not degraded without any problem on the heat resistance. These results demonstrate that the toner of the invention has good weatherability.

Similar results were obtained when the C.I. Solvent Red 49 and the C.I. Pigment Red 48 were, respectively, mixed in amounts of from 40 to 60 parts and, correspondingly, from 60 to 40 parts and also when the amount of the colorant was changed in the range of from 2 to 6 parts per 100 parts of the binder resin.

EXAMPLE 2

| | |
|---|---|
| Saturated polyester resin (Polyester HP-300, available from Nippon Synthetic Chem. Co., Ltd.) | 100 parts |
| Polypropylene (Biscoal 550-P, available from Sanyo Chem. Co., Ltd.) | 4 parts |
| Antistatic agent (Bontron E-48, Orient Chem. Co., Ltd.) | 3 parts |
| Colorant (mixture at a mixing ratio by weight of 1:1 of C.I. Solvent Red 49 (Oil Pink 312, available from Orient Chem. Co., Ltd.) and C.I. Pigment Red 48 (Dainichi Permanent Red, available from Dainichi Pure Chem. Co., Ltd.) | 3 parts |

The composition of the above formulation was treated in the same manner as in Example 1 to obtain a toner. The toner was subjected to evaluation tests in the same manner as in Example 1. Satisfactory results were obtained with respect to the tint, light fastness and heat resistance.

Similar results were obtained when the C.I. Solvent Red 49 and the C.I. Pigment Red 48 were, respectively, mixed in amounts of from 40 to 60 parts and, correspondingly, from 60 to 40 parts and also when the amount of the colorant was changed in the range of from 2 to 6 parts per 100 parts of the binder resin.

EXAMPLE 3

| | |
|---|---|
| Styrene-acrylate resin (Himer T-1000, available from Sanyo Chem. Co., Ltd.) | 100 parts |
| Polypropylene (Biscoal 550-P, available from Sanyo Chem. Co., Ltd.) | 4 parts |
| Antistatic agent (Kayacharge N-3, Nippon Chem. & Pharm. Co., Ltd.) | 3 parts |
| Colorant (mixture at a mixing ratio by weight of 1:1 of C.I. Solvent Red 49 (Oil Pink 312, available from Orient Chem. Co., Ltd.) and C.I. Pigment Red 48 (Dainichi Permanent Red, available from Dainichi Pure Chem. Co., Ltd.) | 3 parts |

The composition of the above formulation was treated in the same manner as in Example 1 to obtain a toner. The toner was subjected to evaluation tests in the same manner as in Example 1. Satisfactory results were obtained with respect to the tint, light fastness and heat resistance.

Similar results were obtained when the C.I. Solvent Red 49 and the C.I. Pigment Red 48 were, respectively, mixed in amounts of from 40 to 60 parts and, correspondingly, from 60 to 40 parts and also when the amount of the colorant was changed in the range of from 2 to 6 parts per 100 parts of the binder resin.

COMPARATIVE EXAMPLE 1

| | |
|---|---|
| Styrene-acrylate resin (Himer T-1000, available from Sanyo Chem. Co., Ltd.) | 100 parts |
| Polypropylene (Biscoal 550-P, available from Sanyo Chem. Co., Ltd. | 4 parts |
| Antistatic agent (Kayacharge N-3, Nippon Chem & Pharm. Co., Ltd.) | 2 parts |
| Colorant C.I. Solvent Red 49 (Oil Pink 312, available from Orient Chem. Co., Ltd.) | 5 parts |

The composition of the above formulation was treated in the same manner as in Example 1 to obtain a toner. The toner was subjected to evaluation tests in the same manner as in Example 1. As a result, although a clear color tint was obtained, the heat resistance was poor. More particularly, when the print image densities prior to and after the sunshine weatherometer test were compared with each other, the density was 1.60 prior to the test and was lowered to 0.90 after 30 hours. Thus, the lowering of the density was undesirably significant.

COMPARATIVE EXAMPLE 2

| | |
|---|---|
| Polyester (Himer ES-508, available from Sanyo Chem. Co., Ltd.) | 100 parts |
| Polypropylene (Biscoal 550-P, available from Sanyo Chem. Co., Ltd. | 2 parts |
| Antistatic agent (Kayacharge N-3, Nippon Chem. & Pharm. Co., Ltd.) | 5 parts |
| Colorant C.I. Pigment Red 48 (Dainichi Permanent Red, available from Dainichi Pure Chem. Co., Ltd.) | 5 parts |

The composition of the above formulation was treated in the same manner as in Example 1 to obtain a toner. The toner was subjected to evaluation tests in the same manner as in Example 1. As a result, although the light fastness and the heat resistance were good, a clear color print could not be obtained.

What is claimed is:

1. A magenta toner for electrophotography which comprises a binder resin and from 0.1 to 10 parts by weight of a colorant per 100 parts by weight of the binder resin, the colorant containing a mixture of from 40 to 60 parts by weight of a Rhodamine dye classified as C.I. Solvent Red 49 and, correspondingly, from 60 to 40 parts by weight of a pigment classified as C.I. Pigment Red 48.

2. A magenta toner according to claim 1, wherein said colorant is contained in an amount of from 2.0 to 6.0 parts by weight per 100 parts by weight of the binder resin.

3. A magenta toner according to claim 1, wherein said colorant consists essentially of the mixture.

4. A magenta toner according to claim 1, wherein said binder resin is a member selected form the group consisting of styrene-acrylate resins, styrene-methacrylate resin, polyesters and mixtures thereof.

5. A magenta toner according to claim 1, wherein said Rhodamine dye is of the formula

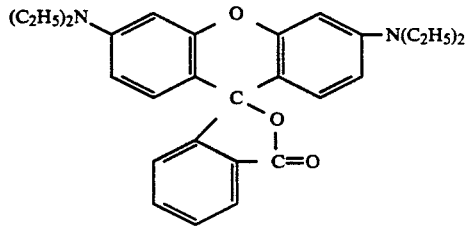

6. A magenta toner according to claim 1, wherein said C.I. Pigment Red 48 is a compound of the following formula

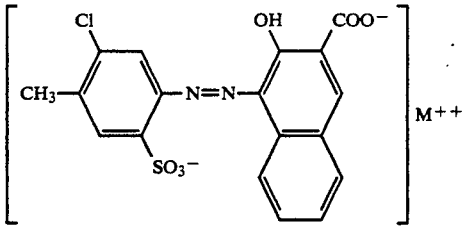

wherein M represents Ca, Ba, Sr or Mn.

7. A magenta toner according to claim 1, wherein said C.I. Pigment Red 48 is of the formula

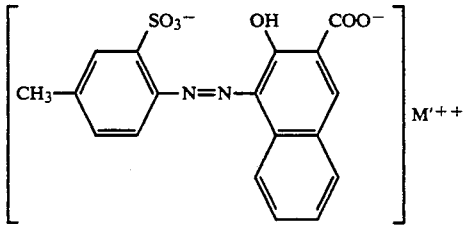

wherein M' represents Ca or Na.

8. A magenta toner according to claim 1, wherein said C.I. Pigment Red 48 is a mixture of compounds of the following formulas

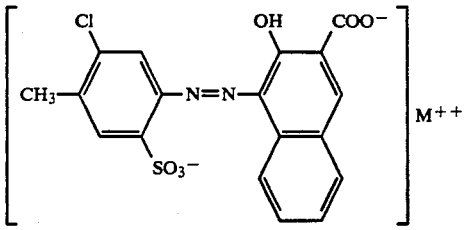

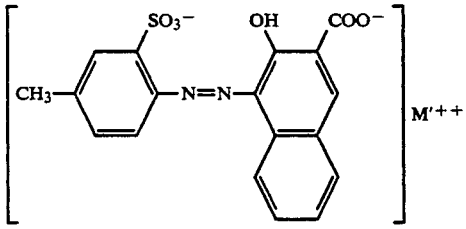

wherein M represents Ca, Ba, Sr or Mn and M' represents Ca or Na.

9. A magenta toner according to claim 1, further comprising a flow control agent in an amount of from 0.01 to 6.0 wt % based on the binder resin.

10. A magenta toner according to claim 1, further from a polypropylene release agent in an amount of from 0.1 to 5 parts by weight per 100 parts by weight of the binder resin.

11. A magenta toner according to claim 1, further comprising a carrier in an amount of from 88 to 97 wt % of the total of the carrier and the toner whereby a two-component developer is obtained.

12. A magenta toner according to claim 1, wherein a chromaticity of the colorant expressed by a L*a*b*c* chromatic system is such that L*=50.0 to 80.0, a*=61.− to 80.0, b*=−10.0 to 40.0, and C*=60.0 to 80.0.

* * * * *

UNITED STATES PATENT AND TRADEMARK OFFICE

CERTIFICATE OF CORRECTION

PATENT NO. : 5,213,932
DATED : May 25, 1993
INVENTOR(S) : Hiromitsu Shimazaki

It is certified that error appears in the above-indentified patent and that said Letters Patent is hereby corrected as shown below:

On the Title page, item [30], change "February 25, 1992" to -- February 25, 1991--.

Signed and Sealed this

Eleventh Day of January, 1994

Bruce Lehman

*Attest:*

BRUCE LEHMAN

*Attesting Officer*

*Commissioner of Patents and Trademarks*